US010115338B2

(12) United States Patent
Zhang et al.

(10) Patent No.: US 10,115,338 B2
(45) Date of Patent: Oct. 30, 2018

(54) DRIVING CIRCUIT AND DISPLAY DEVICE USING THE SAME

(71) Applicant: Wuhan China Star Optoelectronics Technology Co., Ltd., Wuhan, Hubei (CN)

(72) Inventors: Di Zhang, Guangdong (CN); Jun Li, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 130 days.

(21) Appl. No.: 15/328,218

(22) PCT Filed: Dec. 26, 2016

(86) PCT No.: PCT/CN2016/112154
§ 371 (c)(1),
(2) Date: Jan. 23, 2017

(87) PCT Pub. No.: WO2018/112990
PCT Pub. Date: Jun. 28, 2018

(65) Prior Publication Data

US 2018/0211590 A1 Jul. 26, 2018

(30) Foreign Application Priority Data

Dec. 22, 2016 (CN) ..... 2016 1 1200371

(51) Int. Cl.
*G09G 3/3225* (2016.01)
*G09G 3/3208* (2016.01)

(52) U.S. Cl.
CPC ..... *G09G 3/3225* (2013.01); *G09G 3/3208* (2013.01); *G09G 2300/0819* (2013.01); *G09G 2310/0289* (2013.01); *G09G 2310/06* (2013.01)

(58) Field of Classification Search
CPC ..... G09G 3/3225; G09G 2310/06; G09G 2300/0819; G09G 2310/0289
See application file for complete search history.

(56) References Cited

U.S. PATENT DOCUMENTS

2009/0184914 A1 7/2009 Han

FOREIGN PATENT DOCUMENTS

| | | | |
|---|---|---|---|
| CN | 103474038 | A | 12/2013 |
| CN | 105261343 | A | 1/2016 |
| CN | 106128347 | A | 11/2016 |

*Primary Examiner* — Abhishek Sarma
(74) *Attorney, Agent, or Firm* — Andrew C. Cheng

(57) ABSTRACT

A driving circuit is provided. The driving circuit includes an input module for inputting a control signal from a signal input terminal; a pull-down module connected to the input module, used for pulling down the control signal from the input module to a low level; a pull-up module connected to the input module, used for pulling up the control signal from the input module to a high level; and an output module for outputting an output signal to a signal output terminal based on the control of the pull-down module and the pull-up module. Wherein, between the pull-up module and the pull-down module, an eleventh switching element is provided, and the eleventh switching element includes a control terminal, a first connection terminal and a second connection terminal.

7 Claims, 2 Drawing Sheets

DRIVING CIRCUIT AND DISPLAY DEVICE USING THE SAME

BACKGROUND OF THE INVENTION

1. Field of the Invention

The preset invention relates to a driving circuit, and more particularly to a driving circuit having a stable signal.

2. Description of Related Art

Along with the development of the high quality display screen, people seek a larger display screen. Higher resolution, more exciting visual effect, wide viewing angle, high color gamut and high PPI have become the industry trend. An OLED screen has advantages of high contrast ratio, wide viewing angle, high saturation and low power consumption such that the OLED screen has become a cutting of the development of the market.

The pixel driving of the driving technology of OLED belongs to a current type, which requires GOA (gate on array) to provide a scanning signal. At the same time, for a better display effect and threshold voltage compensation effect, an additional pixel circuit is required to provide multiple signals. Wherein, an emission signal can separate a pixel driving period (data signal reading period, anode resetting period and threshold voltage acquiring period) and an OLED emitting period. Each rectangular pulse of the emission signal operates a longer time than a scanning signal so that the requirement of the stability of the circuit is higher. In order to generate a stable emission signal, a generation circuit of the emission signal of the current P type TFT panel is formed by multiple transistors and capacitors.

SUMMARY OF THE INVENTION

The present invention provides a driving circuit for preventing a current leakage.

The present invention also provides a driving circuit of a display device for preventing a current leakage.

According to an exemplary embodiment of the present invention, a driving circuit, comprising: an input module for inputting a control signal from a signal input terminal; pull-down module connected to the input module, used for pulling down the control signal from the input module to a low level; pull-up module connected to the input module, used for pulling up the control signal from the input module to a high level; and an output module for outputting an output signal to a signal output terminal based on the control of the pull-down module and the pull-up module; wherein, between the pull-up module and the pull-down module, an eleventh switching element is provided, and the eleventh switching element includes a control terminal, a first connection terminal and a second connection terminal.

According to an exemplary embodiment of the present invention, the driving circuit includes multiple switching elements and capacitors.

According to an exemplary embodiment of the present invention, the switching element is a thin-film transistor.

According to an exemplary embodiment of the present invention, the input module includes a first switching element and a second switching element, wherein, the first switching element includes a control terminal, a first connection terminal and a second connection terminal, wherein, the control terminal of the first switching element is connected to a first clock signal, the first connection terminal of the first switching element is connected to the signal input terminal, and the second connection terminal of the first switching element is connected to the second switching element; the second switching element includes a control terminal, a first connection terminal and a second connection terminal, wherein, the control terminal of the second switching element is connected to a second clock signal, the first connection terminal of the second switching element is connected to the second connection terminal of the first switching element, and the second connection terminal of the second switching element is connected to the pull-down module; and wherein, the second connection terminal of the first switching element is also connected to the pull-up module and the pull-down module.

According to an exemplary embodiment of the present invention, the pull-down module includes a third switching element, a fourth switching element and a first capacitor, wherein, the third switching element includes a control terminal, a first connection terminal and a second connection terminal, wherein, the control terminal of the third switching element is connected to the first clock signal, the first connection terminal of the third switching element is connected to a first fixed voltage, and the second connection terminal of the third switching element is connected to the first connection terminal of the eleventh switching element; the fourth switching element includes a control terminal, a first connection terminal and a second connection terminal, wherein, the control terminal of the fourth switching element is connected to the first capacitor, the first connection terminal of the fourth switching element is connected to the first clock signal, and the second connection terminal of the fourth switching element is connected to the first connection terminal of the eleventh switching element; and wherein, the control terminal of the fourth switching element is also connected to the input module and the pull-up module.

According to an exemplary embodiment of the present invention, the pull-up module includes a fifth switching element, a sixth switching element, a seventh switching element, an eighth switching element and a second capacitor, wherein, the fifth switching element includes a control terminal, a first connection terminal and a second connection terminal, wherein, the control terminal of the fifth switching element is connected to the second connection terminal of the eleventh switching element, the first connection terminal of the fifth switching element is connected to the input module, and the second connection terminal of the fifth switching element is connected to a second fixed voltage; the sixth switching element includes a control terminal, a first connection terminal and a second connection terminal, wherein, the control terminal of the sixth switching element is connected to the second connection terminal of the eleventh switching element, the first connection terminal of the sixth switching element is connected to the second clock signal, and the second connection terminal of the sixth switching element is connected to the second capacitor; the seventh switching element includes a control terminal, a first connection terminal and a second connection terminal, wherein, the control terminal of the seventh switching element is connected to the second clock signal, the first connection terminal of the seventh switching element is connected to the second capacitor, and the second connection terminal of the seventh switching element is connected to the eighth switching element; the eighth switching element includes a control terminal, a first connection terminal and a second connection terminal, wherein, the control terminal of the eighth switching element is connected to the input module and the pull-down module, the first connection terminal of the eighth switching element is connected to the second fixed voltage, and the second connection terminal of the eighth switching element is connected to the second connection terminal of the seventh switching element; the second capacitor has a first connection terminal and a second connection terminal, the first connection terminal of the second capacitor is connected to the control terminal of the fifth switching element, and the second connection terminal of the second capacitor is connected to the second connection terminal of the fifth switching element; and wherein, the second connection terminal of the eighth switching element is also connected to the output module.

According to an exemplary embodiment of the present invention, the output module includes a ninth switching element, a tenth switching element and a third capacitor, wherein, the ninth switching element includes a control terminal, a first connection terminal and a second connection terminal, wherein, the control terminal of the ninth switching element is connected to the second connection terminal of the first capacitor, the first connection terminal of the ninth switching element is connected to the first fixed voltage, and the second connection terminal of the ninth switching element is connected to the signal output terminal; the tenth switching element includes a control terminal, a first connection terminal and a second connection terminal, wherein, the control terminal of the tenth switching element is connected to the second connection terminal of the eight switching element of the pull-up module, the first connection terminal of the tenth switching element is connected to the signal output terminal, and the second connection terminal of the ninth switching element is connected to a second fixed voltage; and the third capacitor includes a first connection terminal and a second connection terminal, the first connection terminal of the third capacitor is connected to the second connection terminal of the eighth switching element of the pull-up module, and the second terminal of the third capacitor is connected to the second fixed voltage.

According to an exemplary embodiment of the present invention, the control terminal of the eleventh switching element is connected to a first fixed voltage.

According to an exemplary embodiment of the present invention, the first fixed voltage is a low level voltage and the second fixed voltage is a high level voltage.

BRIEF DESCRIPTION OF THE DRAWINGS

The flowing will combine the figures to illustrate the exemplary embodiments; the preset invention will become clear and better to be understood in these and other aspects, wherein.

DETAILED DESCRIPTION OF THE PREFERRED EMBODIMENT

The following will combine figures to illustrate the pixel circuit provided by the embodiments of the present in detail. The same numerals in the figures indicate the same elements.

Figure 1:
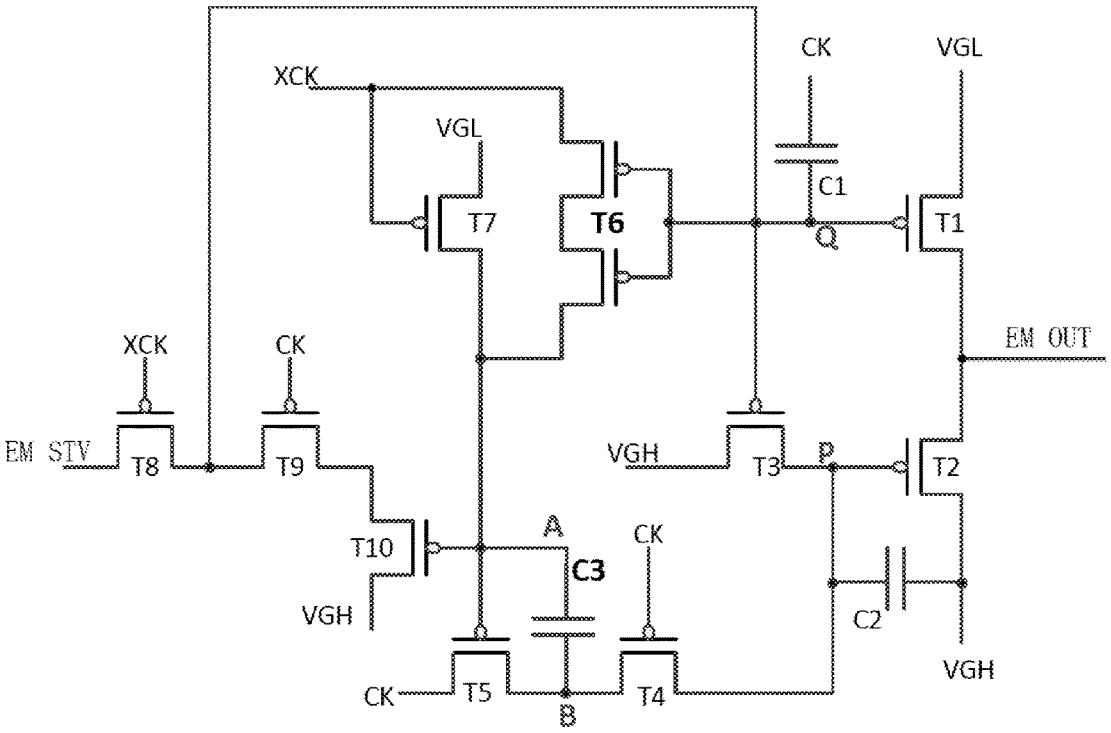
FIG. 1 (Prior Art)
FIG. 1 is a schematic diagram of an EM circuit according to the conventional art.

FIG. 1 is a schematic diagram of an EM circuit according to the conventional art. For the conventional EM (emission) signal generation circuit, it is formed by multiple transistors and capacitors. The specific structure is as shown in FIG. 1. In the EM circuit shown in FIG. 1, the function of a capacitor C3 is very important, which is directly related to if an output signal can be pulled up to a high level signal. Two terminals of the capacitor C3 are respectively "A" and "B". Wherein, the point "A" is connected to a drain of a transistor T7 and a drain/source of a transistor T6. A clock signal XCR is continuously under a clock status so that a leakage current is more serious. Specifically, under a coupling effect of a capacitor C1, the voltage level of the point "Q" is very unstable. In the operation process, a transistor T6 is easily to be turned on such that a lot of electric charge will lose from the capacitor C3 so that the operation of the EM circuit is unstable. Therefore, the conventional technology improves the above phenomenon through increasing an area of the capacitor C3 and changing the transistor T6 as a double channel thin-film transistor.

Based on the deficiency of the conventional art, the present invention provides a driving circuit for improving the above current leakage phenomenon. The following content will refer to FIG. 2 and FIG. 3 to describe the driving circuit of the present invention in detail.

Figure 2:
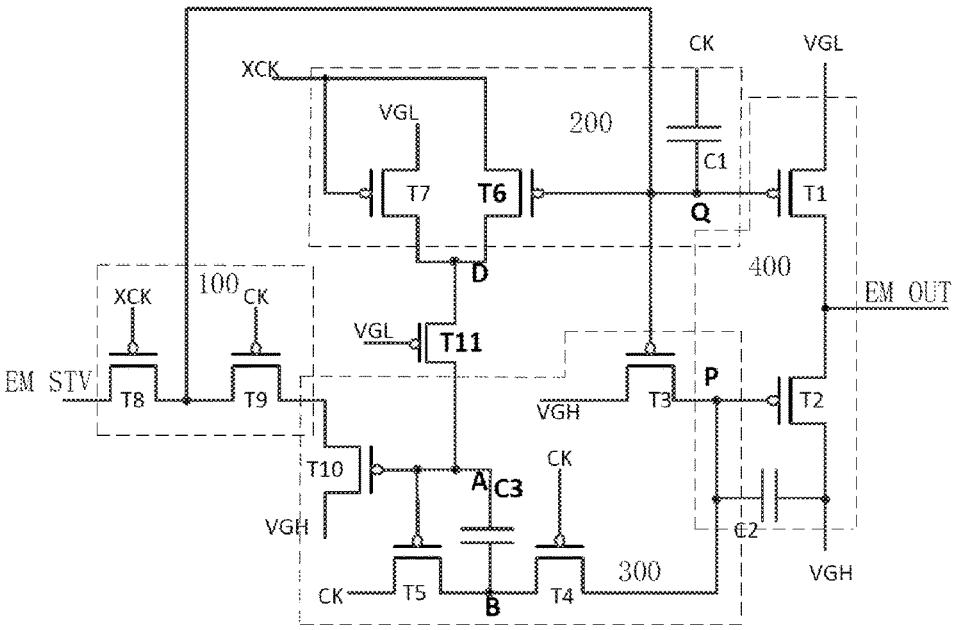
FIG. 2 is a schematic diagram of an EM circuit according to the present invention.
Figure 3:
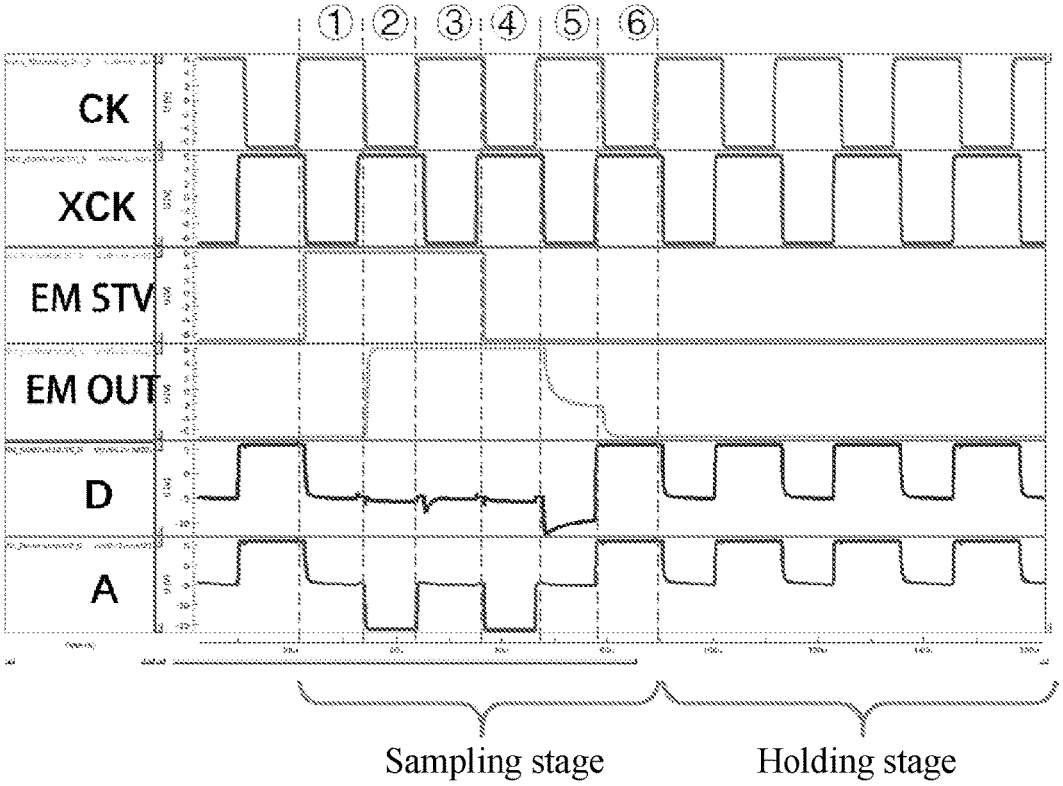
FIG. 3 is a schematic waveform diagram of the EM circuit according to the present invention.

FIG. 2 is a schematic diagram of an EM circuit according to the present invention, and FIG. 3 is a schematic waveform diagram of the EM circuit according to the present invention. With reference to FIG. 2, the driving circuit according to the present invention includes an input module 100, a pull-down module 200, a pull-up module 300 and an output module 400. The input module 100 outputs a control signal based on switching elements, clock signal and the emission signal. The pull-down module 200 is electrically connected to the input module 100 for pulling down the control signal from the input module 100 to a low level. The pull-up module 300 is electrically connected to the input module 100 for pulling up the control signal from the input module 100 to a high level. The output module 400 is connected to the pull-down module 200 and the pull-up module 300 for outputting an output signal corresponding to the control of the pull-down module 200 and the pull-up module 300.

The EM circuit according to the present invention can include multiple switching elements and capacitors. In other words, through the multiple switching elements and capacitors to form input module 100, the pull-down module 200, the pull-up module 300 and the output module 400 in the EM circuit.

The input module 100 can include a switching element such as a transistor. In the specific embodiment of the present invention, as shown in FIG. 2, a switching element T8 and a switching element T9 are included in the input module 100. Each of the switching element T8 and the switching element T9 has a control terminal, a first connection terminal and a second connection terminal. Wherein, the control terminal of the switching element T8 can input a first clock signal XCK, the first connection terminal of the switching element T8 is connected to an emission signal input terminal, and the emission signal input terminal can be inputted with an emission signal EM STV. The second connection terminal of the switching element T8 can connect to the first connection terminal of the switching element T9, and can connect to the pull-down module 200 and the pull-up module 300. The control terminal of the switching element T9 can input a second clock signal CK. The second connection terminal of the switching element T9 can connect to the pull-down module 200.

The pull-down module 200 can include multiple switching elements (such as transistors) and capacitors. In the embodiments of the present invention, as shown in FIG. 2, a switching element T6, a switching element T7 and a capacitor C1 can be included in the pull-down module 200. Each of the switching element T6 and the switching element T7 can include a control terminal, a first connection terminal and a second connection terminal. The capacitor C1 can include a first connection terminal and a second connection terminal. The control terminal of the switching element T6 is connected to the output module 400. The first connection terminal of the switching element T6 is inputted with the first clock signal XCK. The second connection terminal of the switching element T6 can connect to the pull-up module 300 (for example, through a switching element T11). The control terminal of the switching element T7 can input the first clock signal XCK. The first connection terminal of the switching element T7 can input a voltage level signal VGL. The second connection terminal of the switching element T7 can connect to the pull-up module 300 (for example, through a switching element T11). The first terminal of the capacitor C1 can input the second clock signal CK, the second terminal of the capacitor C1 can connect to the output module 400.

The pull-up module 300 can include multiple switching elements (such as transistors) and capacitors. In the embodiments of the present invention, as shown in FIG. 2, a switching element T3, a switching element T4, a switching element T5, a switching element T10 and a capacitor C3 can be included in the pull-down module 200. Each of the switching element T3, the switching element T4, the switching element T5, and the switching element T10 has a control terminal, a first connection terminal and a second connection terminal. The capacitor C3 has a first connection terminal and a second connection terminal. The control terminal of the switching element T3 is connected to the pull-down module 200 and the input terminal 100 (for example, connected to the control terminal of T6 and the second connection terminal of T8). The first connection terminal of the switching element T3 is connected to a high level voltage VGH, the second connection terminal of the switching element T3 is connected to the second connection terminal of the switching element T4, and can also connect to the output module 400 (for example, the control terminal of the switching element T1). The control terminal of the switching element T4 can input the second clock signal CK. The first connection terminal of the switching element T4 can connect to the second connection terminal of the switching element T5. The control terminal of the switching element T5 can connect the control terminal of the switching element T10 (the first connection terminal of the capacitor C3). The first connection terminal of the switching element T5 can input the second clock signal CK, the second connection terminal of the switching element T5 can connect to the second connection terminal of the capacitor C3. The first connection terminal of the switching element T10 can connect to the input module 100, specifically, connect to the second connection terminal of the switching element T9. The second connection terminal of the switching element T10 can input the high level voltage VGH.

The output module 400 can include multiple switching elements and capacitors. In the specific embodiment of the present invention, as shown in FIG. 2, a switching element T1, a switching element T2 and a capacitor C2 can be included in the output module 400. Each of the switching element T1, the switching element T2 includes a control terminal, a first connection terminal and a second connection terminal. The capacitor C2 can include a first connection terminal and a second connection terminal. The control terminal of the switching element T1 can connect to the pull-down module 200, specifically, connected to the control terminal of the T6 of the pull-down module. The first connection terminal of the switching element T1 can input the low level voltage VGL, and the second connection terminal of the switching element T1 can connect to the first connection terminal of the switching element T2. Besides, the second connection terminal of the switching element T1 can also connect to an emission signal output terminal. The emission signal output terminal can output an emission signal EM OUT. The control terminal of the switching element T2 can connect the pull-up module 300, specifically, can connect to the second connection terminal of the switching element T3. The second connection terminal of the switching element T2 can connect to a high level voltage VGH. The first terminal of the capacitor C2 can connect to the pull-up module 300, and specifically, can connect to the first connection terminals of the switching elements T3, T4 of the pull-up module. The second connection terminal of the capacitor C2 can connect to a high level voltage VGH.

Besides, between the pull-down module 200 and the pull-up module 300, the switching element T11 is provided. The switching element T11 can include a control terminal, a first connection terminal and a second connection terminal. The control terminal of the switching element T11 can connect to the low level voltage VGL, the first connection terminal of the switching element T11 can connect to the pull-down module 200, and specifically can connect to the second connection terminal of the switching element T6 (the second connection terminal of the switching element T7). The second connection terminal of the switching element T11 can connect the pull-up module 300, and specifically can connect to the control terminal of the switching element T10 (the control terminal of switching element T5, the first connection terminal of the capacitor C3).

The above content combines a specific embodiment to describe the basic structure of the driving circuit according to the present invention. However, person having ordinary skilled in the art can modify the composition and layout of the driving circuit, the present invention is not limited to the above specific embodiment.

The following will combine FIG. 2 and FIG. 3 to describe the operation principle of the driving circuit in detail.

The working stages of the driving circuit according to embodiments of the present invention can include a sampling stage and a holding stage.

As shown in FIG. 2 and FIG. 3, the sampling stage is a waveform transmitting stage, which can include six stages:

Stage ①: when the second clock signal CK and the emission signal EM STV are at the high level voltage VGH, and the first clock signal XCK is at low level, the input module 100 can input the high level voltage to the pull-down module 200, and turning off T1 at the same time so that the low level voltage VGL is stopped from entering the emission signal output terminal EM OUT. In this situation, because T2 is not turned on, the emission signal output terminal EM OUT remains to output the low level voltage VGL. At the same time, because the control terminal of T7 is inputted with the first clock signal XCK having a low level, the T7 is turned on. At this time, the low level voltage can be transmitted to the first connection terminal (point A) of the capacitor C3 through the point "D". T3 can be turned on so that the high level can be transmitted to the second connection terminal (point B) of the capacitor C3 such that the capacitor C3 stores charges for preparing a next stage;

Stage ②: when the first clock signal XCK and the emission signal EM STV are at a high level voltage and the second clock signal CK is at a low level voltage, because T9 and T10 are turned on, the high level voltage VGH can be inputted to the pull-down module in order to turn off the pull-down module. At the same time, the second connection terminal (point B) of the capacitor C3 of the pull-up module 300 is pulled down because of the bootstrap effect of the capacitor. Besides, because T6 is turned off, the pull-up module 300 is activated. In the coupling effect of the capacitor, the voltage of the point "A" is coupled to be lower such that T3 is turned on continuously. At the same time, T4 is turned on such that the low level voltage can be smoothly inputted to the control terminal (point P) of the T2 in order to turn on T2 so that the high level voltage can be outputted to the emission signal output terminal;

Stage ③: when the second clock signal CK and the emission signal EM STV are at the high level voltage VGH, and the first clock signal XCK is at a low level voltage, the input module 100 is turned on through T8 so as to input the high level voltage to the pull-down module 200 in order to turn off the pull-down module. Besides, the output module 100 makes the point "P" to be a low level voltage through C2 so that T2 is turned on continuously such that the high level voltage continuously input to the emission signal output terminal. At the same time, the switching element T7 is turned on because the first clock signal at the control terminal of T7 such that the low level voltage can transmit to the first connection terminal (point A) of the capacitor C3 through point "D". Then, T3 is turned on, and the high level voltage is transmitted to the second connection terminal (point "B") of the capacitor C3 so that the capacitor C3 stores charges to prepare for a next stage;

Stage ④: when the first clock signal XCK and the emission signal EM STV are at the high level voltage VGH, and the second clock signal CK is at a low level voltage, T9 and T10 are turned on, the high level voltage VGH is inputted to the pull-down module in order to turned off the pull-down module. At the same time, the second connection terminal (point "B") of the capacitor C3 of the pull-up module 300 is pulled down. Because of the coupling effect of the capacitor, the first connection terminal (point "A") of the capacitor C3 is coupled to be lower so that T3 is turned on continuously. At the same time, T4 is turned on such that the low level voltage can be smoothly inputted to the control terminal (point "P") of the T2 in order to turned on T2 so that the high level voltage can be outputted to the emission signal output terminal, which is consistent as the stage ②;

Stage ⑤: when the first clock signal XCK and the emission signal EM STV are at low level voltage, and the second clock signal CK is at a high level voltage, T6 is turned on and the pull-up module 300 is turned off. The input module 100 transmits the low level voltage of the inputted signal EM STV to the pull-down module 200 and turning on the T1 of the output module in order to input the low level voltage to the emission signal output terminal. Besides, the first connection terminal and the control terminal are both low level voltages, and base on the property of the threshold voltage of P-type TFT, the voltage level of the output signal will be higher than the voltage level of point "Q" by one threshold voltage;

Stage ⑥: when the second clock signal CK and the emission signal EM STV are at low level voltages, and the first clock signal XCK is at high voltage, because of the coupling effect of the capacitor C1, the control terminal (point "Q") of T1 is coupled to be lower by the second clock signal CK in order to fully turn on T1 such that the voltage level of the output signal is fully equal to the low level voltage VGL.

Besides, under the holding stage, because the input module 100 continuously input the low level voltage VGL to the pull-down module 200 such that the control terminal (point Q) of T1 is continuously a low level voltage in order to turn on T1 and the emission signal output terminal continuously outputs low level voltage.

With reference to FIG. 2 and FIG. 3, according to the driving circuit of the present invention, between the pull-down module 200 and the pull-up module 300 (between point "D" and point "A"), the switching element (for example, a transistor) T11 is disposed. Because the control terminal (the gate electrode) of T11 is connected to the VGL direct-current signal, when the voltage between the first connection terminal (the gate electrode) and the second connection terminal (the drain electrode) is maintained about or above VGL, the TFT is under a conductive status. However, when the voltage at any terminal is lower than VGL, the switching element T11 is under a cutoff status so as to stop the voltage of another terminal from decreasing.

Specifically, in another aspect, through disposing the T11 between the pull-down module 200 and the pull-up module 300, the present invention can stop the voltage level of the point "D" from decreasing when the charges of the capacitor C3 pull down the voltage level at the first connection terminal (point "A") under the bootstrap effect so as to effectively decrease the leakage current when the two switching elements T7 and T6 are turned off to increase the holding ability of the charges of the capacitor C3. Besides, during the working stages of FIG. 3 (that is, from stage ② to stage ④), because the second clock signal CK is inputted to the second connection terminal (point B) of the capacitor C3 under the low level voltage, the other terminal (point "A") of the capacitor C3 will be pulled down (lower than the low level voltage VGL) under the bootstrap effect. At this time, the control terminal of T11 is connected to the low level voltage VGL, and T11 is turned off so that affecting the voltage level of point "D" by a fluctuation of the voltage level of the point "A" is stopped in order to reduce the leakage current of T6 and T7 such that the double channel T6 can be changed to a signal channel structure.

In another aspect, under the bootstrap coupling effect of the capacitor C1, the voltage level of point "Q" is very unstable, in the process that the second clock signal CK changing from a high level voltage to a low level voltage, the voltage level at the second terminal (point Q) of the capacitor C1 will be pulled down through the bootstrap effect, and the value is decided by the size of the capacitor. Once the decreased value of the voltage level at point Q is over the threshold voltage, T6 will enter a conductive status so that the charge stored in the capacitor C3 is greatly lost, which will seriously affect the output of a next emission signal. Here, T11 can cut off the larger current when T6 is turned on so as to maintain the charged stored in the capacitor C3 so that the capacitance value of the capacitor C3 can be appropriately reduced.

In summary, the exemplary embodiment of the present disclosure provides a driving circuit, through disposing a switching element between the pull-up module and the pull-down module of the driving circuit, a double-channel element in the driving circuit can become a single channel element and reduce a size of a capacitor so that when providing a stable emission signal, the area of the layout of the driving circuit can be reduced at the same time.

What is claimed is:

1. A driving circuit, comprising: an input module for inputting a control signal from a signal input terminal; a pull-down module connected to the input module, used for pulling down the control signal from the input module to a low level; a pull-up module connected to the input module, used for pulling up the control signal from the input module to a high level; and an output module for outputting an output signal to a signal output terminal based on the control of the pull-down module and the pull-up module; wherein, between the pull-up module and the pull-down module, an eleventh switching element is provided, and the eleventh switching element includes a control terminal, a first connection terminal and a second connection terminal;

wherein, the input module includes a first switching element and a second switching element, wherein, the first switching element includes a control terminal, a first connection terminal and a second connection terminal, wherein, the control terminal of the first switching element is connected to a first clock signal, the first connection terminal of the first switching element is connected to the signal input terminal, and the second connection terminal of the first switching element is connected to the second switching element; the second switching element includes a control terminal, a first connection terminal and a second connection terminal, wherein, the control terminal of the second switching element is connected to a second clock signal, the first connection terminal of the second switching element is connected to the second connection terminal of the first switching element, and the second connection terminal of the second switching element is connected to the pull-down module; and wherein, the second connection terminal of the first switching element is also connected to the pull-up module and the pull-down module;

wherein, the pull-down module includes a third switching element, a fourth switching element and a first capacitor, wherein, the third switching element includes a control terminal, a first connection terminal and a second connection terminal, wherein, the control terminal of the third switching element is connected to the first clock signal, the first connection terminal of the third switching element is connected to a first fixed voltage, and the second connection terminal of the third switching element is connected to the first connection terminal of the eleventh switching element; the fourth switching element includes a control terminal, a first connection terminal and a second connection terminal, wherein, the control terminal of the fourth switching element is connected to the first capacitor, the first connection terminal of the fourth switching element is connected to the first clock signal, and the second connection terminal of the fourth switching element is connected to the first connection terminal of the eleventh switching element; and wherein, the control terminal of the fourth switching element is also connected to the input module and the pull-up module;

wherein, the pull-up module includes a fifth switching element, a sixth switching element, a seventh switching element, an eighth switching element and a second capacitor, wherein, the fifth switching element includes a control terminal, a first connection terminal and a second connection terminal, wherein, the control terminal of the fifth switching element is connected to the second connection terminal of the eleventh switching element, the first connection terminal of the fifth switching element is connected to the input module, and the second connection terminal of the fifth switching element is connected to a second fixed voltage; the sixth switching element includes a control terminal, a first connection terminal and a second connection terminal, wherein, the control terminal of the sixth switching element is connected to the second connection terminal of the eleventh switching element, the first connection terminal of the sixth switching element is connected to the second clock signal, and the second connection terminal of the sixth switching element is connected to the second capacitor; the seventh switching element includes a control terminal, a first connection terminal and a second connection terminal, wherein, the control terminal of the seventh switching element is connected to the second clock signal, the first connection terminal of the seventh switching element is connected to the second capacitor, and the second connection terminal of the seventh switching element is connected to the eighth switching element; the eighth switching element includes a control terminal, a first connection terminal and a second connection terminal, wherein, the control terminal of the eighth switching element is connected to the input module and the pull-down module, the first connection terminal of the eighth switching element is connected to the second fixed voltage, and the second connection terminal of the eighth switching element is connected to the second connection terminal of the seventh switching element; and the second capacitor has a first connection terminal and a second connection terminal, the first connection terminal of the second capacitor is connected to the control terminal of the fifth switching element, and the second connection terminal of the second capacitor is connected to the second connection terminal of the fifth switching element; wherein, the second connection terminal of the eighth switching element is also connected to the output module;

wherein, the output module includes a ninth switching element, a tenth switching element and a third capacitor, wherein, the ninth switching element includes a control terminal, a first connection terminal and a second connection terminal, wherein, the control terminal of the ninth switching element is connected to the second connection terminal of the first capacitor, the first connection terminal of the ninth switching element is connected to the first fixed voltage, and the second connection terminal of the ninth switching element is connected to the signal output terminal; the tenth switching element includes a control terminal, a first connection terminal and a second connection terminal, wherein, the control terminal of the tenth switching element is connected to the second connection terminal of the eight switching element of the pull-up module, the first connection terminal of the tenth switching element is connected to the signal output terminal, and the second connection terminal of the ninth switching element is connected to a second fixed voltage; and the third capacitor includes a first connection terminal and a second connection terminal, the first connection terminal of the third capacitor is connected to the second connection terminal of the eighth switching element of the pull-up module, and the second terminal of the third capacitor is connected to the second fixed voltage.

2. The driving circuit according to claim 1, wherein, the driving circuit includes multiple switching elements and capacitors.

3. The driving circuit according to claim 1, wherein, the switching element is a thin-film transistor.

4. The driving circuit according to claim 1, wherein, the control terminal of the eleventh switching element is connected to a first fixed voltage.

5. The driving circuit according to claim 1, wherein, the first fixed voltage is a low level voltage and the second fixed voltage is a high level voltage.

6. The driving circuit according to claim 4, wherein, the first fixed voltage is a low level voltage and the second fixed voltage is a high level voltage.

7. A display device including a driving circuit, and the driving circuit comprises: an input module for inputting a control signal from a signal input terminal; a pull-down module connected to the input module, used for pulling down the control signal from the input module to a low level; a pull-up module connected to the input module, used for pulling up the control signal from the input module to a high level; and an output module for outputting an output signal to a signal output terminal based on the control of the pull-down module and the pull-up module; wherein, between the pull-up module and the pull-down module, an eleventh switching element is provided, and the eleventh switching element includes a control terminal, a first connection terminal and a second connection terminal;

wherein, the input module includes a first switching element and a second switching element, wherein, the first switching element includes a control terminal, a first connection terminal and a second connection terminal, wherein, the control terminal of the first switching element is connected to a first clock signal, the first connection terminal of the first switching element is connected to the signal input terminal, and the second connection terminal of the first switching element is connected to the second switching element; the second switching element includes a control terminal, a first connection terminal and a second connection terminal, wherein, the control terminal of the second switching element is connected to a second clock signal, the first connection terminal of the second switching element is connected to the second connection terminal of the first switching element, and the second connection terminal of the second switching element is connected to the pull-down module; and wherein, the second connection terminal of the first switching element is also connected to the pull-up module and the pull-down module;

wherein, the pull-down module includes a third switching element, a fourth switching element and a first capacitor, wherein, the third switching element includes a control terminal, a first connection terminal and a second connection terminal, wherein, the control terminal of the third switching element is connected to the first clock signal, the first connection terminal of the third switching element is connected to a first fixed voltage, and the second connection terminal of the third switching element is connected to the first connection terminal of the eleventh switching element; the fourth switching element includes a control terminal, a first connection terminal and a second connection terminal, wherein, the control terminal of the fourth switching element is connected to the first capacitor, the first connection terminal of the fourth switching element is connected to the first clock signal, and the second connection terminal of the fourth switching element is connected to the first connection terminal of the eleventh switching element; and wherein, the control terminal of the fourth switching element is also connected to the input module and the pull-up module;

wherein, the pull-up module includes a fifth switching element, a sixth switching element, a seventh switching element, an eighth switching element and a second capacitor, wherein, the fifth switching element includes a control terminal, a first connection terminal and a second connection terminal, wherein, the control terminal of the fifth switching element is connected to the second connection terminal of the eleventh switching element, the first connection terminal of the fifth switching element is connected to the input module, and the second connection terminal of the fifth switching element is connected to a second fixed voltage; the sixth switching element includes a control terminal, a first connection terminal and a second connection terminal, wherein, the control terminal of the sixth switching element is connected to the second connection terminal of the eleventh switching element, the first connection terminal of the sixth switching element is connected to the second clock signal, and the second connection terminal of the sixth switching element is connected to the second capacitor; the seventh switching element includes a control terminal, a first connection terminal and a second connection terminal, wherein, the control terminal of the seventh switching element is connected to the second clock signal, the first connection terminal of the seventh switching element is connected to the second capacitor, and the second connection terminal of the seventh switching element is connected to the eighth switching element; the eighth switching element includes a control terminal, a first connection terminal and a second connection terminal, wherein, the control terminal of the eighth switching element is connected to the input module and the pull-down module, the first connection terminal of the eighth switching element is connected to the second fixed voltage, and the second connection terminal of the eighth switching element is connected to the second connection terminal of the seventh switching element; and the second capacitor has a first connection terminal and a second connection terminal, the first connection terminal of the second capacitor is connected to the control terminal of the fifth switching element, and the second connection terminal of the second capacitor is connected to the second connection terminal of the fifth switching element; wherein, the second connection terminal of the eighth switching element is also connected to the output module;

wherein, the output module includes a ninth switching element, a tenth switching element and a third capacitor, wherein, the ninth switching element includes a control terminal, a first connection terminal and a second connection terminal, wherein, the control terminal of the ninth switching element is connected to the second connection terminal of the first capacitor, the first connection terminal of the ninth switching element is connected to the first fixed voltage, and the second connection terminal of the ninth switching element is connected to the signal output terminal; the tenth switching element includes a control terminal, a first connection terminal and a second connection terminal, wherein, the control terminal of the tenth switching element is connected to the second connection terminal of the eight switching element of the pull-up module, the first connection terminal of the tenth switching element is connected to the signal output terminal, and the second connection terminal of the ninth switching element is connected to a second fixed voltage; and the third capacitor includes a first connection terminal and a second connection terminal, the first connection terminal of the third capacitor is connected to the second connection terminal of the eighth switching element of the pull-up module, and the second terminal of the third capacitor is connected to the second fixed voltage.

* * * * *